US008323128B2

(12) United States Patent
Rigoli

(10) Patent No.: US 8,323,128 B2
(45) Date of Patent: Dec. 4, 2012

(54) NET FRAME ASSEMBLY AND ANTI-REBOUND SYSTEM

(76) Inventor: Michael Rigoli, Wrentham, MA (US)

( * ) Notice: Subject to any disclaimer, the term of this patent is extended or adjusted under 35 U.S.C. 154(b) by 206 days.

(21) Appl. No.: 12/658,375

(22) Filed: Feb. 12, 2010

(65) Prior Publication Data

US 2011/0201460 A1 Aug. 18, 2011

(51) Int. Cl.
*A63B 63/00* (2006.01)

(52) U.S. Cl. ..... 473/478; 273/400

(58) Field of Classification Search ..... 473/415, 473/421, 474, 476, 478, 520; 273/127 B; 5/98.1

See application file for complete search history.

(56) References Cited

U.S. PATENT DOCUMENTS 5,413,340 A * 5/1995 Potvin et al. ..... 273/127 B
5,476,266 A * 12/1995 Caruso ..... 473/478
6,561,931 B1 * 5/2003 Reeves ..... 473/471
6,579,196 B1 * 6/2003 Yoon ..... 473/421
7,074,141 B2 * 7/2006 Bryant et al. ..... 473/478
7,150,690 B1 * 12/2006 Cusick ..... 473/478
7,241,235 B2 * 7/2007 Caruso ..... 473/478
7,341,531 B2 * 3/2008 Caruso ..... 473/478
2003/0144091 A1 * 7/2003 Dickson ..... 473/477
2008/0108458 A1 * 5/2008 Winningham et al. ..... 473/478
2008/0108459 A1 * 5/2008 Winningham et al. ..... 473/478
2009/0209372 A1 * 8/2009 Rigoli ..... 473/435
2011/0201460 A1 * 8/2011 Rigoli ..... 473/478

* cited by examiner

*Primary Examiner* — Gene Kim
*Assistant Examiner* — M Chambers
(74) *Attorney, Agent, or Firm* — Bay State IP, LLC

(57) ABSTRACT

A lightweight sports net frame assembly and anti-rebound system allowing straightforward assembly, enhanced rigidity, expedited replacement of the net and ease in retrieval of objects from the net frame assembly during usage of said assembly. The net frame assembly comprises substantially cylindrical cavities that allow for cables, rods or other tethering means to pass through said cavities and in turn securely fasten within the side frame members. The joints of the frame are comprised of various interlocking pieces, which provide a smooth outer surface at the joints, reinforce the rigidity of the frame and diminish rotational moments on individual segments. A frame stability system is incorporated.

21 Claims, 25 Drawing Sheets

101

NET FRAME ASSEMBLY AND ANTI-REBOUND SYSTEM

FIELD OF THE INVENTION

The present invention relates generally to sports net frame assemblies, specifically designed to exhibit great strength to weight ratio, superior design versatility allowing increased anti-swivel properties and superior frame rigidity and the ability to attach a net component in a minimal time lapse and illustrating no gapping between net and frame assemblies through the use on superior channel and groove systems, designed to accept the use of differing material in order to eliminate oxidation, rust and wear.

BACKGROUND OF INVENTION

Many sports require the explicit use of a full goal. These sports include, soccer, ice hockey, field hockey, lacrosse, handball and water polo, to name but a few. These sports involve one team being awarded a point or points whenever a team manages to place an object, a ball, puck or the like into the opposing team's net.

Various types of sports net frames are in existence, often designed for specific dimensions and sizes for the relevant sport to which they are intended to be used. Further, these net frames are often designed so that they may be quickly assembled and disassembled (including attaching the appropriate sports net to the goal frame). Also, these sports net frames are constructed of various types of materials, including plastics, metals and woods. In addition, various types of net frames are designed so that they can "fold up" in order to become more compact for transporting the sports goal frame to another location.

Many net designs require the assembly of the frame before the netting can be added to the frame. This takes more time during both the assembly and disassembly of the goal net. Also, these other designs often exhibit compromised construction upon continued play, included gaps, slits, holes or apertures that exist between the posts and the net, which allows for game object, such as balls, disks or pucks, etc., to pass through to the other side of the goal, increasing the time necessary to retrieve the ball or puck and thus decreasing playing time. Of higher import, these design flaws regularly create major stoppage of play issues during game time conditions, in conjunction with possibly altering outcomes of games themselves, as often times determining whether or not the game object actually went into the goal and came out through an aperture in the net. Often times, it appears that the game object went in and came through an aperture, but in reality, the game object passed over the net.

Further, numerous designs often sacrifice light-weight properties to improve the rigidity, durability and ability to remain anchored to the ground. In addition, many systems utilize snap together net frame assembly comprising depression parts, since as button and aperture assemblies. These systems often wear or seize, as do the piping systems associated with such mechanisms.

Of highest import, often times during practice or even game time, a net may become impaired and thus play must be delayed for repair or replacement of the net. In such a situation, what is needed is a highly efficient net replacement system which allows for net replacement within a minimal period of time in order that the players, and coaches, aren't forced to mull aimlessly for long periods of time, as the addition of a new net to these systems can take an hour or more, thus breaking the momentum of the game.

Therefore what is needed is a rigid sports goal frame assembly that affords the user the ability to utilize differing materials (metals, polymers, composites, etc) within linkage areas, in order to increase strength and rigidity and concurrently prevent corrosion and subsequent breakdown of part, while exhibiting ease of net replacement to be accomplished substantially in place. Additionally needed is a goal frame which can be assembled without the existence of gaps between the net and the frame, thus preventing balls or puck passing though the goal frame assembly. Further, this goal frame assembly should maintain superior strength to weight characteristics, while exhibiting the necessary rigidity and durability, while also remaining properly anchored to the ground or playing surface.

SUMMARY OF THE INVENTION

The instant invention, as illustrated herein, is clearly not anticipated, rendered obvious or even present in any of the prior art mechanisms, either alone or in any combination thereof. Illustrated herein is a novel net frame assembly and anti-rebound system exhibiting an excellent strength to weight ratio by providing a high degree of rigidity through superior design features.

Therefore, is object of the present system to provide a net frame assembly and anti-rebound system exhibiting substantially zero gapping between the net assembly and frame assembly. The instant system affords an apparatus which distinctly limits interruption and delay associated with net assembly failure during game time conditions. The instant system provides a sturdy, corrosion resistance platform designed to ably withstand all weather challenges and conditions. Thus, the several embodiments of the instant invention are illustrated herein.

Therefore, it is an object of the present system to provide a net frame assembly that substantially reduces net frame installation and replacement time. The present invention relates generally to sports net frame assemblies, specifically designed to exhibit great strength to weight ratio, superior design versatility allowing increased anti-swivel properties and superior frame rigidity and the ability to attach a net component in a minimal time lapse and illustrating no gapping between net and frame assemblies through the use on superior channel and groove systems, designed to accept the use of differing material in order to eliminate oxidation, rust and wear.

Additionally, the present system is to provide a net frame assembly that will provide superior ground stability and ground contact friction within a lightweight and easy-to-assembly frame by providing ground gripping members. These ground gripping members may be comprised of a myriad of materials as known in the art, including but limited to integral polymeric or rubberized materials.

A further object of the present system is to introduce a net frame assembly that provides a balance system which prevents the instant system from instituting rollovers during play, wherein removably attachable mass units may be added to the balance system, substantially about the rear of said net frame assembly. Another object of the present system is to provide a net frame assembly that will substantially reduce the time spent to maintain the net frame assembly for game play purposes by substantially reducing the time needed to replace the net.

Another object of the present system is to provide a net frame assembly that may be assembled to substantially NCAA lacrosse regulation goal size, while another object of the present system is to provide a net frame assembly that is compatible with a backstop system. An additional object of the present system is to provide a net frame assembly that is substantially compatible with various sports and games, comprising lacrosse, soccer, ice hockey, field hockey, handball, polo, water polo and other sports.

Another object of the present system is to provide a net frame assembly that comprises consumer affordable materials and is manufactured at consumer affordable rates.

Another object of the present system is to provide a net frame assembly that substantially eliminates gaps between the net frame and the net, wherein balls or pucks would otherwise be able to pass through said gaps.

Another object of the present system is to provide a net frame assembly that will substantially reduce the time spent to maintain the net frame assembly for gameplay purposes by substantially reducing the time needed to replace the net.

Another object of the present system is to provide a net frame assembly that is compatible with replaceable nets, wherein said nets comprise cable holding pockets. An additional object of the present system is to provide a net frame assembly that is substantially compatible with a collapsible and removable backstop, wherein said backstop comprises a net that is angled in a substantially forward position, wherein said net is disposed to be substantially free from tangling and wherein said net is substantially quick to replace and substantially simple to replace.

Additionally, the present system provides a net frame assembly that is substantially compatible with an anti-rebound system, wherein said anti-rebound system comprises a removable polymer or like material coated device, wherein said removable polymer or like material coated device substantially dampens impacts on it, thereby substantially reducing the probability of rebounding balls, pucks and other solid objects.

Another object of the present system is to provide a net frame assembly that is substantially compatible with a removable ball retrieval system, wherein said removable ball retrieval system comprises a fabric device or member that allows balls that hit the inside of the goal to roll forward and substantially face the goal, thereby causing the balls to substantially collect into one pocket for easy retrieval.

Another object of the present system is to provide a net frame assembly that is substantially compatible with a removable practice screen with holes, wherein said removable practice screen easily removes from the face of the goal and/or pockets, wherein said pockets substantially quickly and substantially simply attaches and removes from the corners of the goal.

Another object of the present system is to provide a net frame assembly that is substantially compatible with an integrated removable rebound wall, wherein said integrated removable rebound wall substantially rests at the top of said goal.

Another object of the present system is to provide a net frame assembly that is substantially compatible with at least one wheel member and/or at least one wheel assembly, wherein said at least one wheel member and/or at least one wheel assembly make it easier to transport said net frame assembly from place to place. Another object of the instant invention is to provide click-in, static parts, with no braises or welds, which add rigidity and longevity to the overall system.

These together with other objects of the invention, along with various features of novelty which characterize the invention, are pointed out with particularity in the claims and Detailed Description of the Embodiments Sections, and drawings of this application, with all said sections also adding to this disclosure.

DETAILED DESCRIPTION OF THE DISCLOSED EMBODIMENTS

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as net frame assemblies of different sizes, dimensions, and construction materials.

Figure 1:
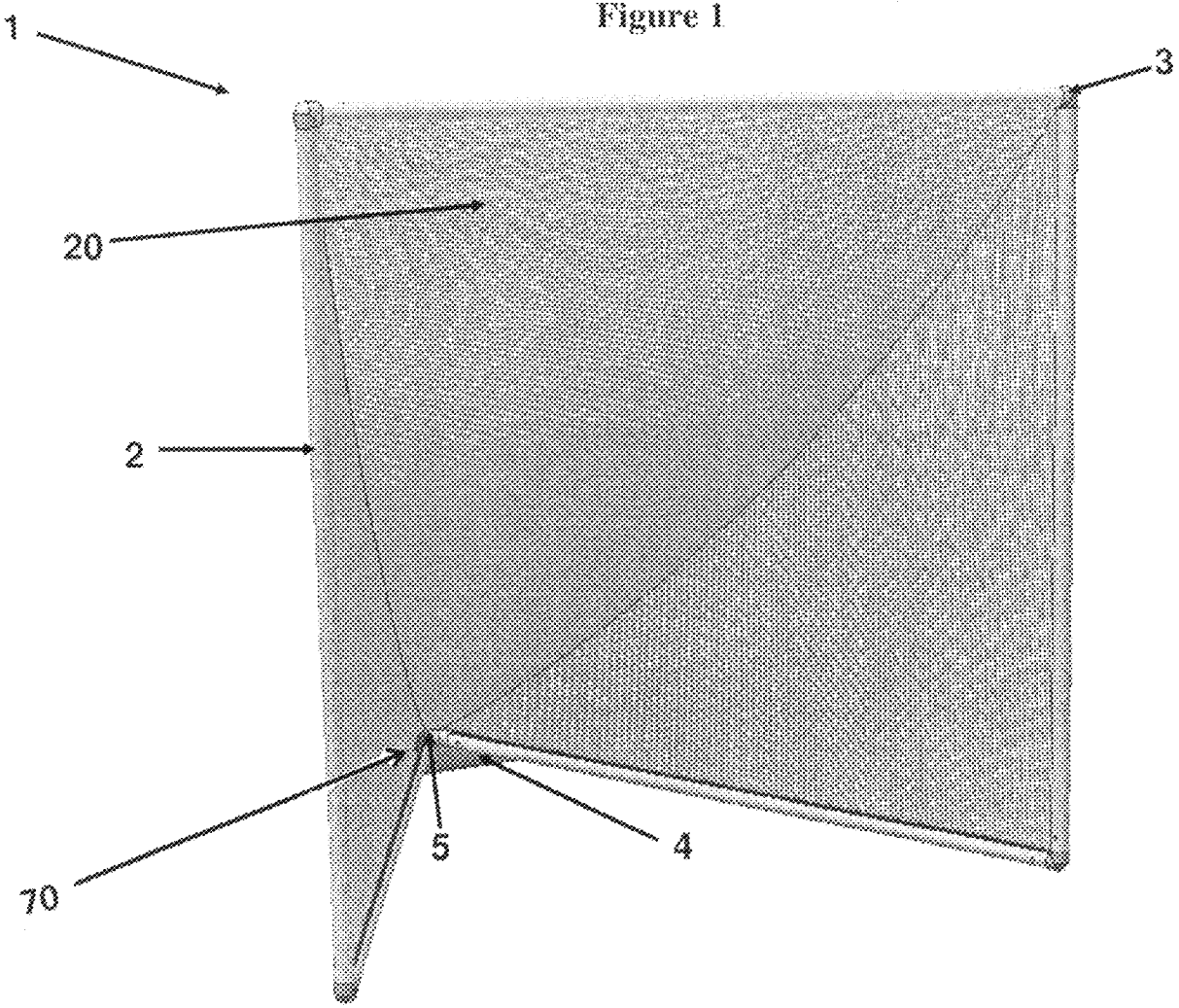
FIG. 1 illustrates a first angled frontal view of the net frame assembly fully, wherein said net frame assembly is fully assembled and a net is substantially installed to said net frame assembly.
Figure 2:
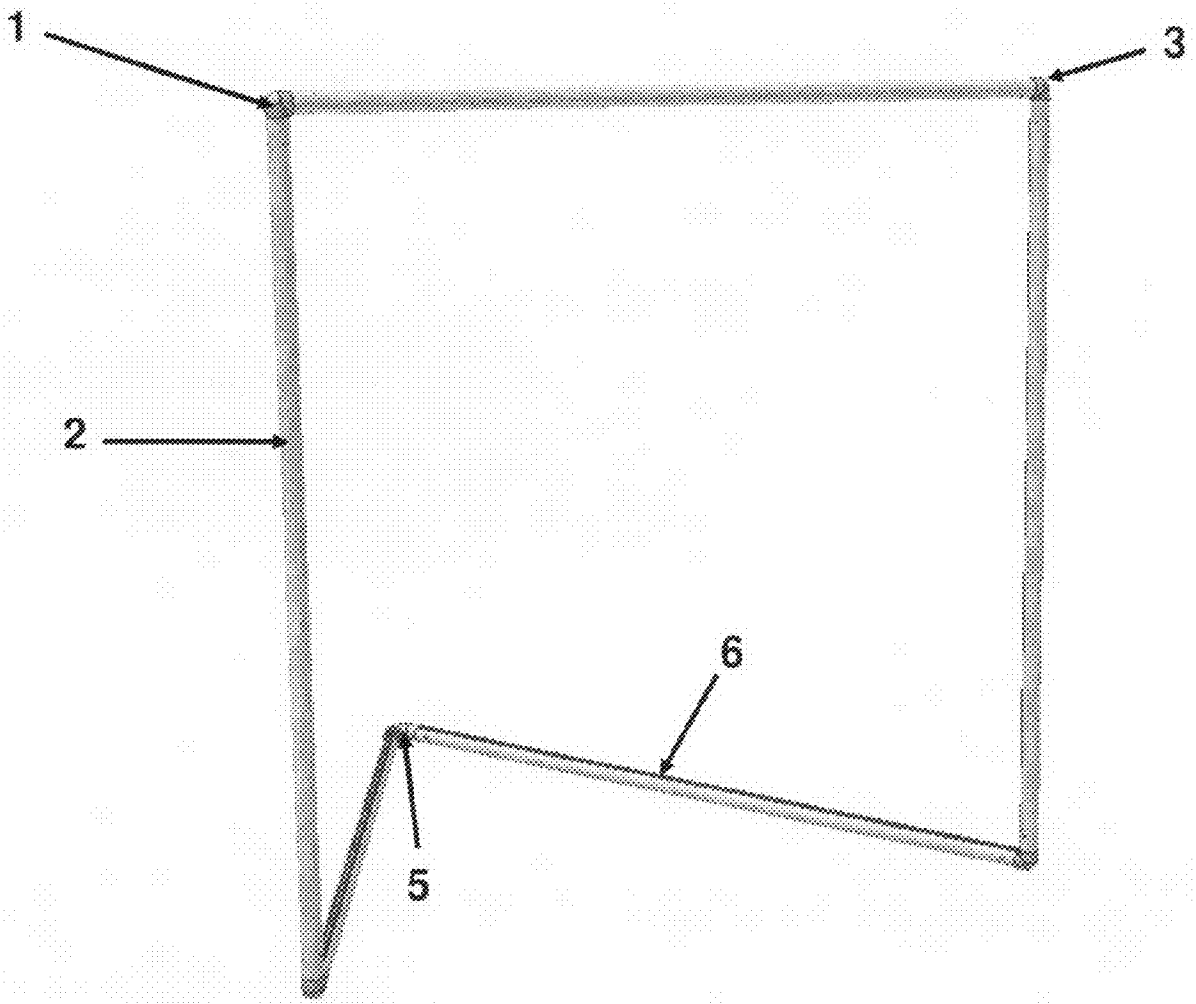
FIG. 2 illustrates an angled frontal view of the net frame assembly fully assembled with the net pocket grooves exposed and visible.

FIGS. 1 and 2 illustrate one embodiment of the net frame assembly 1, comprising a plurality of frame members 2, at least one substantially perpendicular frame joint assembly 10 and at least one substantially curved joint member 5. Further illustrated in FIG. 1 is a ball and puck collection pocket 4, wherein balls and pucks substantially gather for easy player retrieval and a net 20 that is substantially installed to the net frame assembly 1. Additionally illustrated in FIG. 2 are internally facing tether member passage grooves 6, wherein tether member passage grooves 6 are, in this embodiment, internally molded components of said frame members 2. Additionally, there exists a small ball retrieval opening 70, cutaway within the rearward portion of the net 20 and positioned such that balls may be retrieve by reaching from behind the overall apparatus, inside the goal area, without having to come out onto the playing surface and thus interrupt play.

Figure 3:
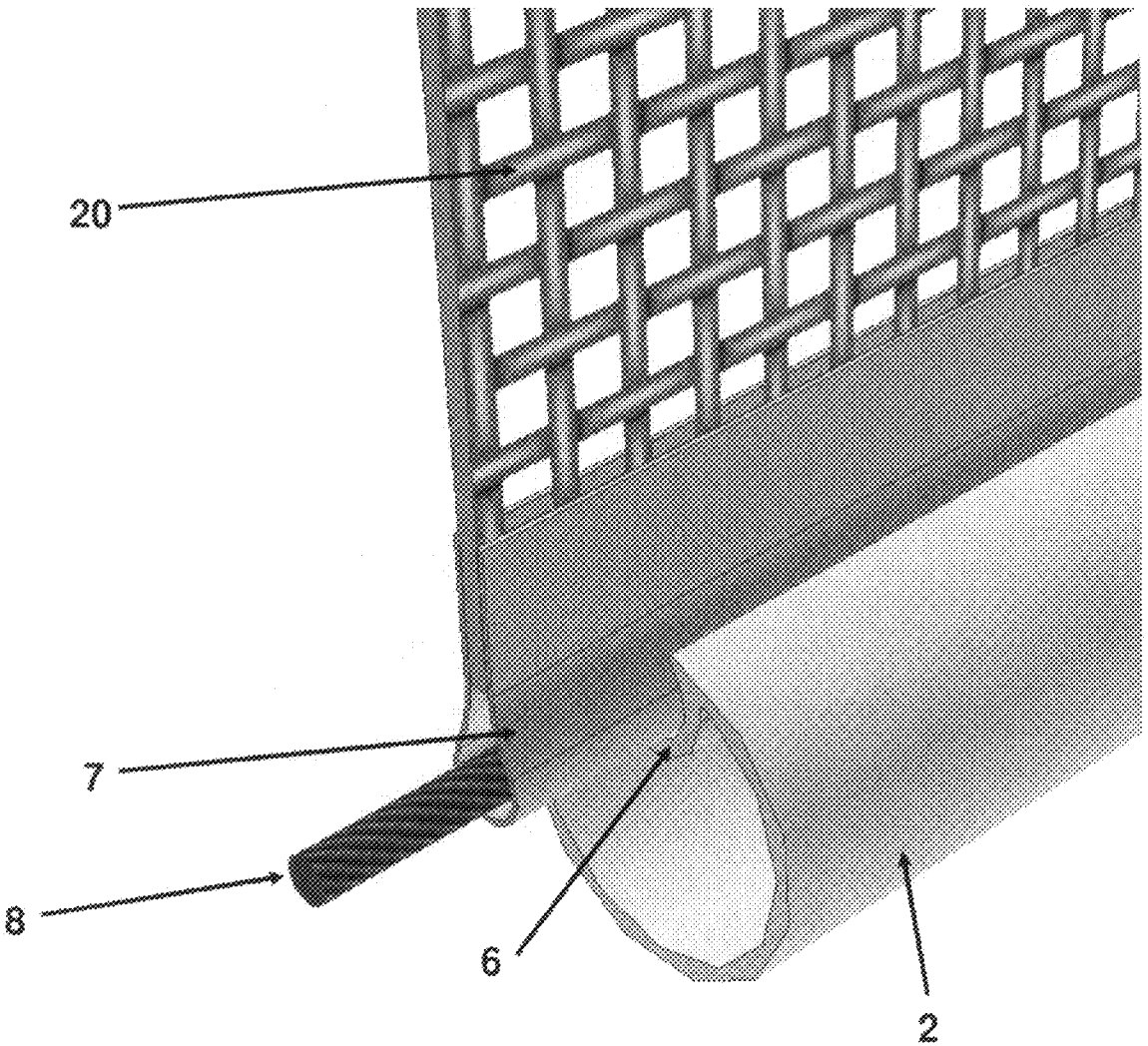
FIG. 3 illustrates an exploded view of one section of the net frame assembly, wherein a section of a cable pocket edge cradling a cable is inserted to a section of a net pocket groove.

FIG. 3 illustrates a close view of the a net cable/rod securing or retaining system, wherein said net cable/rod securing system comprises an inner projectile motion absorbing member 20 (such as a net), a tether member passage 7, a tethering member 8, such as a cable, and a tether member passage groove 6 that is internally molded as a component of a frame member 2. In this embodiment the net cable/rod pocket is attached to the inner projectile motion absorbing member 20, about one edge of said inner projectile motion absorbing member 20, and said tethering member 8 passes through said tether member passage 7. The instant embodiment of said net cable securing system completes its securing function by then placing said tether member passage 7 with said tethering member 8 through said tether member passage groove 6.

Figure 3A:
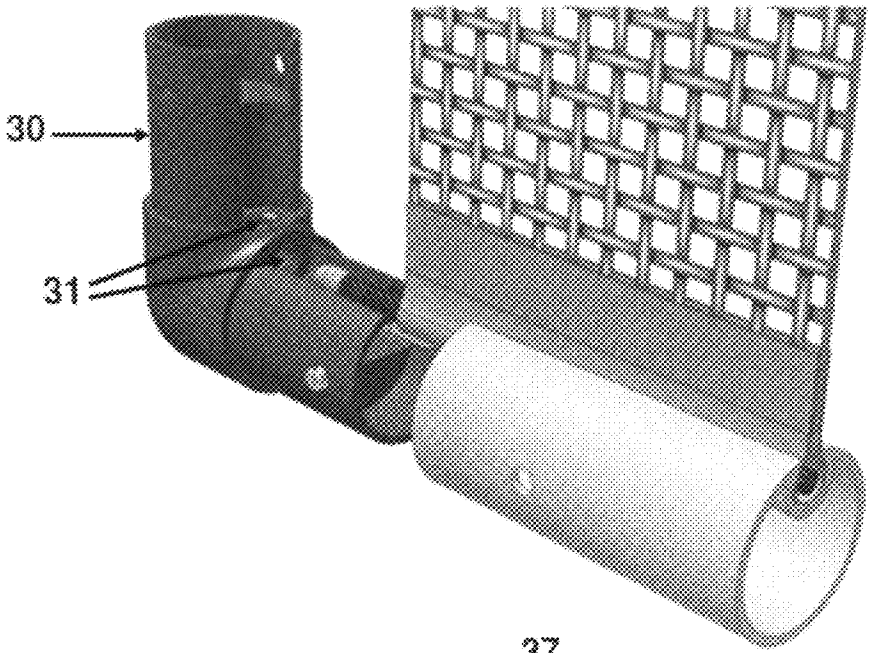
FIG. 3A illustrates an exploded view of one embodiment of the instant invention, wherein a corner joint net frame assembly, cables and rear cable stoppers are illustrated.
Figure 3B:
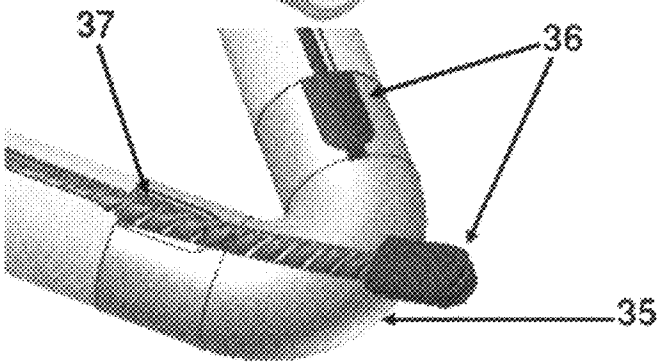
FIG. 3B illustrates an exploded view of one embodiment of the instant invention, wherein a corner joint net frame assembly, cables and rear cable stoppers are illustrated.

FIG. 3A illustrates three types of joints utilized in the instant invention. One joint comprises a preformed elbow joint member 30 that comprises cable securing member cavities 31. FIG. 3B illustrates a third joint featured in the instant invention comprises a substantially V-angled joint assembly 35, wherein the angle formed by the protruding joint members is substantially less then ninety degrees. Further, the V-angled joint assembly 35 comprises cable stopper cavity members 37, wherein cable stopper members 36 may be removeably secured.

FIGS. 4-8A illustrate various views of a frame joint assembly 10 as it would be attached to at least one frame member 2, wherein said frame joint assembly comprises at least one elbow joint member 12 (or at least one preformed elbow joint member 30), at least one interlocking joint member 13, 13A, a tethering member 8 and a tether securing member 9.

Figure 4:
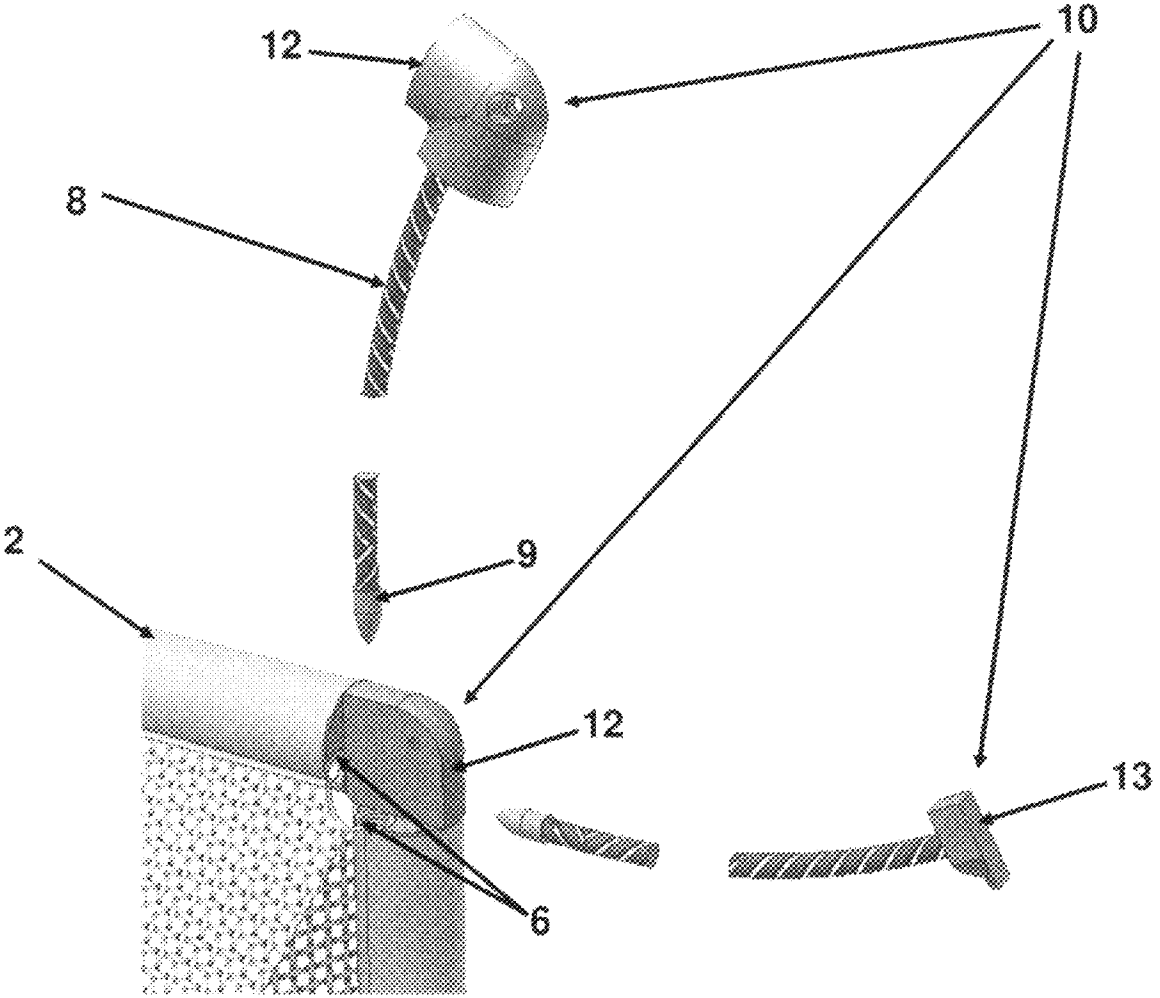
FIG. 4 illustrates an exploded view of one of the joint assemblies of the instant net frame assembly invention in a first possible installation position (locking screw not shown)

FIG. 4 illustrates an exploded view of a frame joint assembly 10 before its various components are installed. As show, said tether securing member 9 is attached to said tethering member 8, wherein said tethering member is in turn attached to one member of either a elbow joint 12 or a lock joint member 13. In this example the tether securing member 9 and tethering member 8 pass through there respective tether member passage grooves 6 (where the tethering member 9 that is attached to the lock joint member 13 passes through the tethering member passage groove 6, which is horizontal to bottom of the net frame 1, and the tethering member 9 which is attached to the elbow joint 12 passes through the tether member passage grooves 6 that is vertical to the bottom of the net frame 1).

Figure 4A:
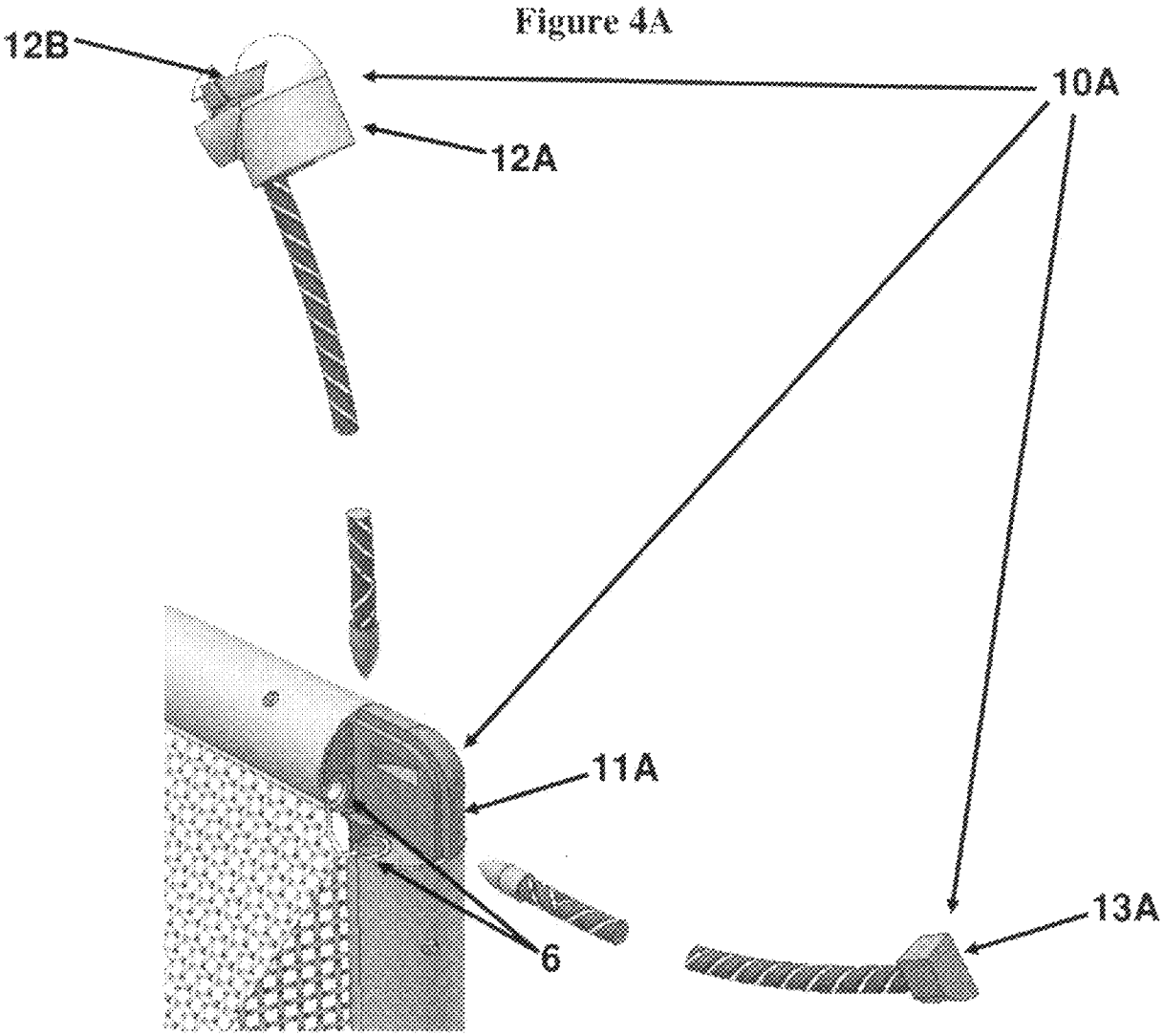
FIG. 4A illustrates a side rear view of an embodiment of the net frame assembly, wherein horizontal and vertical cable securing members are not installed and one corner assembly comprises a latch assembly.
Figure 4B:
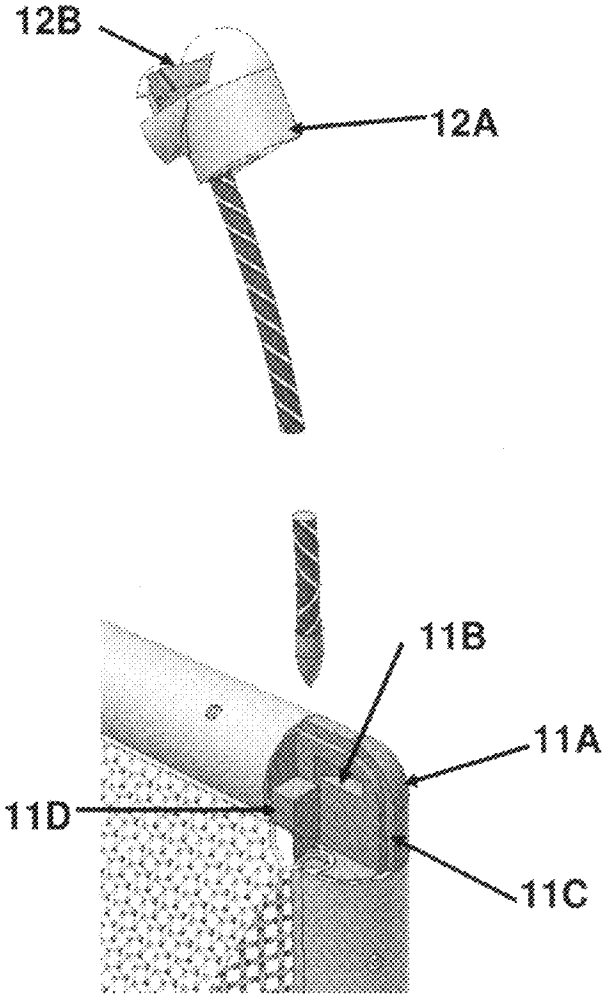
FIG. 4B illustrates a side rear view of an embodiment of the net frame assembly, wherein the horizontal securing cable is installed and the vertical securing cable is not installed and one corner assembly comprises a latch assembly.

FIGS. 4A and 4B illustrate exploded views of a frame joint assembly as substantially shown in FIG. 4, in different stages of assembly and with a different embodiment of the instant invention. For instance, FIG. 4A illustrates a elbow joint member 12A that further comprises a latch assembly 12B that removably attaches to an second elbow joint member 11A that allows for the latch assembly 12B to be locked into said second elbow joint member 11A by a latch assembly cavity member 11B (see FIG. 4B). As shown in FIG. 4B, before completing assembly, a cable member (see FIG. 4) is placed through a cavity member 6 (see FIGS. 4A and 4B) until a cable stopping member 13 is flush against the entrance to said cavity member 6.

Once the cable stopping member is flush against the entrance to said cavity member 6, the elbow joint member 12A may be placed over said cable stopping member while being placed next to said second elbow joint member 11A so that they can fit in the elbow joint member 12A and the second elbow joint member 11A lock together via the grove cavity 11C comprised within the second elbow joint member 11A.

Once placed together with the latch fully secured, a completed latched elbow joint assembly 10A is fully assembled and secured. Once in place, the rod adds flexible rigidity to the system.

Figure 5:
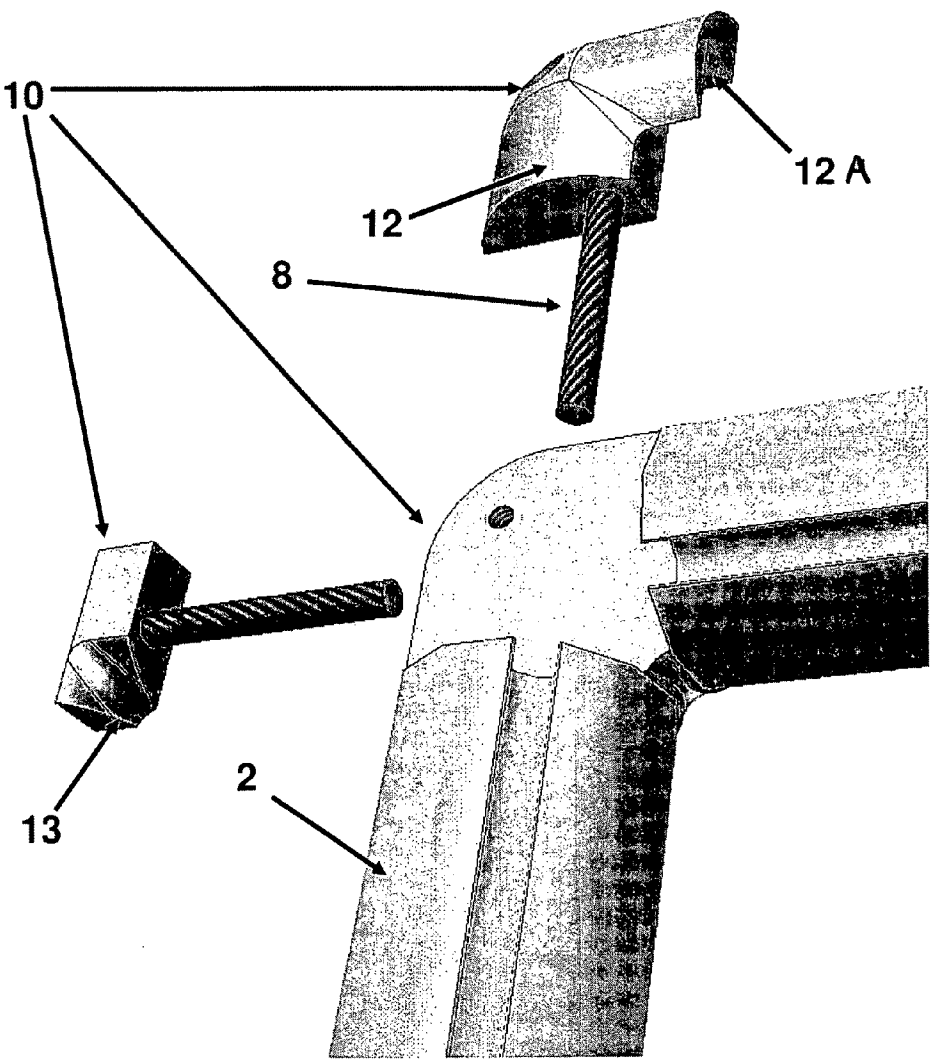
FIG. 5 illustrates an exploded view of the joint assemblies of the instant net frame assembly invention in a second possible installation position before the cables are inserted into the internally visible net grooves (locking screw not shown)
Figure 6:
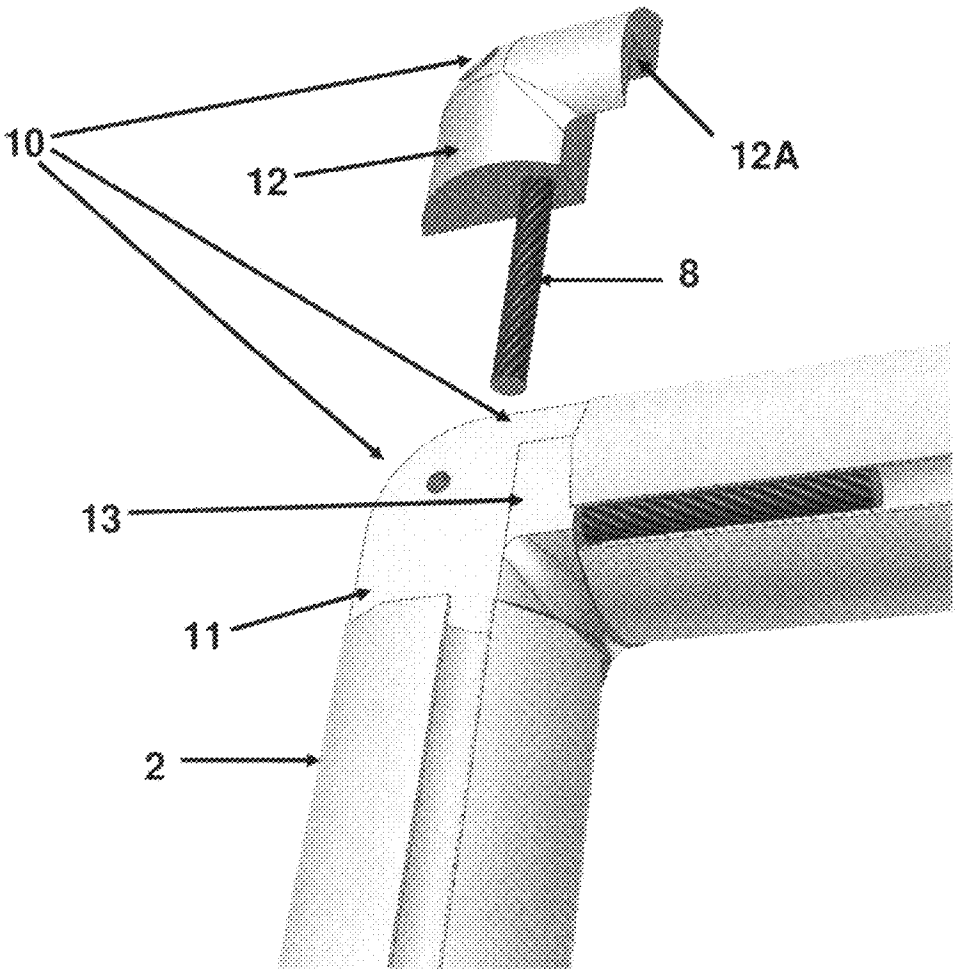
FIG. 6 illustrates an exploded view of the joint assemblies of the instant net frame assembly invention in a second possible installation position after one internally visible cable is inserted into one of the internally visible net grooves (locking screw not shown)

FIGS. 5, 6, 7, 7A and 7B illustrate various stages of the assembly process in attaching and securing the frame joint assembly to the net frame 1 for more then one embodiment of the instant invention. FIG. 5 illustrates the respective positions of the elbow joint 12 and the lock joint member 13 after their respective tether securing members have been passed through their respective tether member passage grooves 6. FIG. 5 also illustrates the lock joint cavity 12A of the elbow joint 12, wherein the lock joint member 13 interlocks with the joint elbow 12. FIG. 6 illustrates the lock joint member 13 with its tethering member 8 fully passed through its respective tether member passage groove 6, wherein said lock joint member is now adjacently interlocked to a foundation elbow 11.

Figure 7:
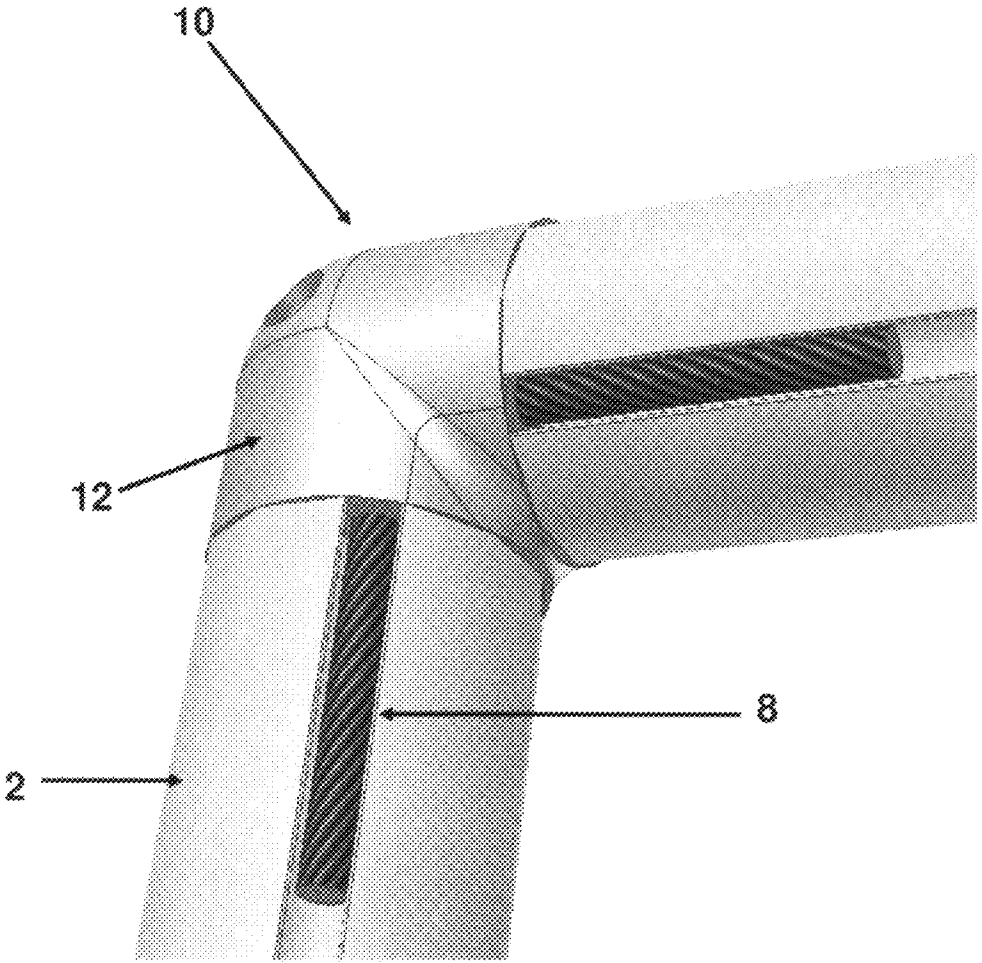
FIG. 7 illustrates a joint assembly of the instant net frame assembly invention in a second possible installation position after two internally visible cables are inserted into the internally visible net grooves and after the complete joint assembly is fully assembled (locking screw not shown)
Figure 7B:
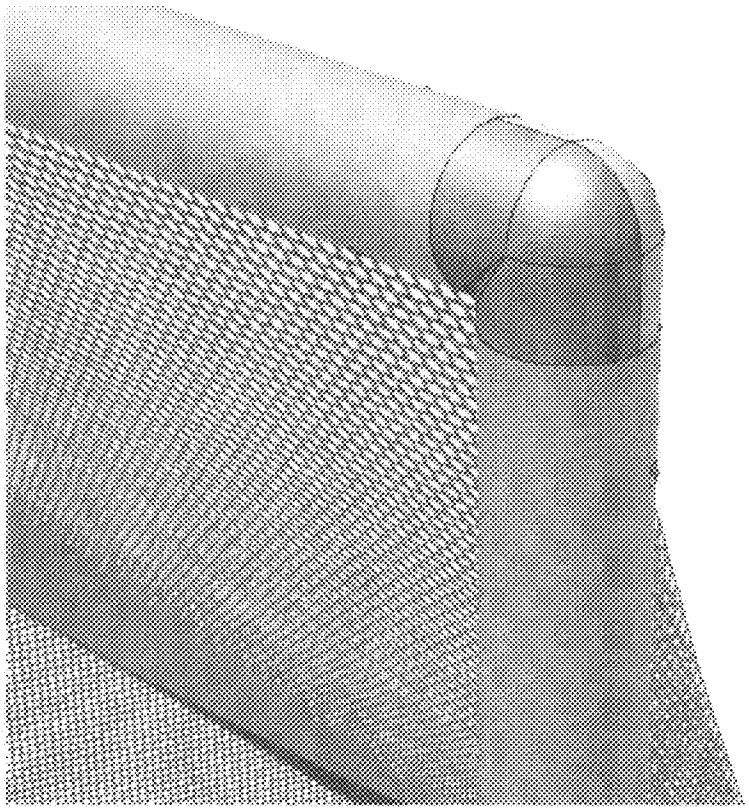
FIG. 7B illustrates a front view of an embodiment of the instant invention featuring a fully assembled joint assembly.
Figure 7A:
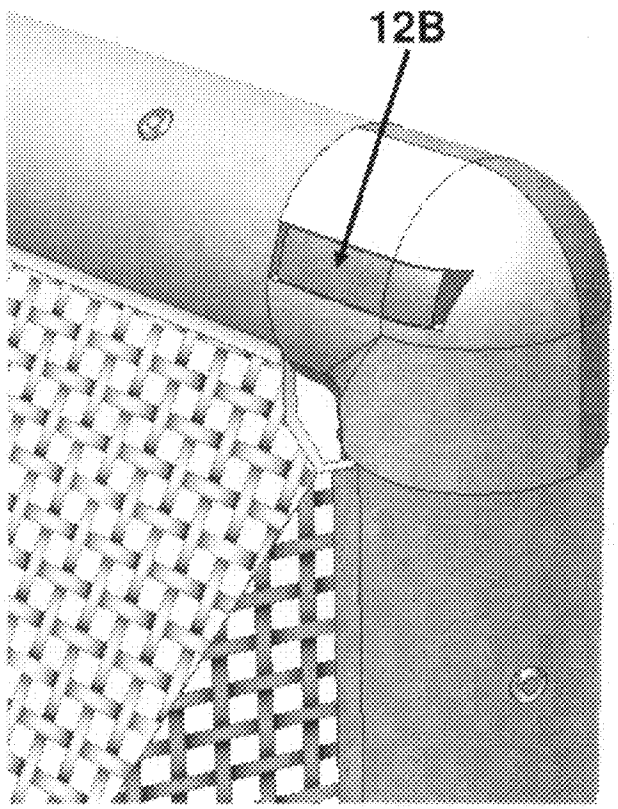
FIG. 7A illustrates a front view of an embodiment of the instant invention featuring a fully assembled joint assembly, wherein the joint assembly comprises a securing latch assembly that is secured into place.

FIG. 7 illustrates the relative positions of both the lock joint member 13 and elbow joint 12 when both their respective tethering members 8 have fully passed through their respective net pocket grooves 6. Additionally in FIG. 7 the lock joint member 13 rests within the lock joint cavity 12A of the elbow joint 12, thereby attaching said lock joint member 13 and said elbow joint 12. FIG. 7A illustrates an embodiment of the instant invention where a latched elbow joint assembly is used, wherein the latch assembly 12B is securely placed in position. FIG. 7B illustrates an embodiment of the instant invention where a non-latched elbow joint assembly is used and securely assembled.

Figure 8A:
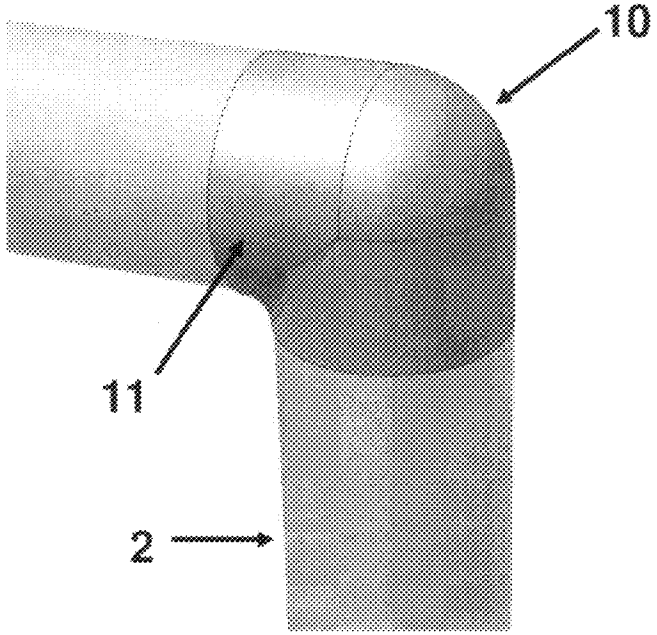
FIG. 8A illustrates a fully assembled joint assembly of the instant net frame assembly invention from a first possible installation position.
Figure 8:
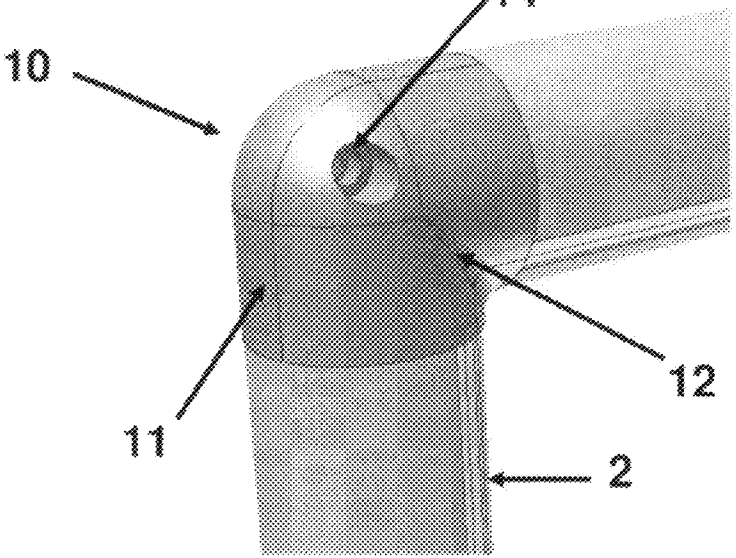
FIG. 8 illustrates a fully assembled joint assembly of the instant net frame assembly invention from a second possible installation position (locking screw not shown)

FIGS. 8 and 8A illustrate two views of a fully assembled frame joint assembly 10, and further illustrate the relative positions of the foundation elbow 11 and the elbow joint 12. Further, as visible in FIG. 8 is a securing member cavity 14, wherein a securing member such nut, screw or other similar type of securing means passes through said securing member cavity 14 to securing the components of the fully assembled frame joint assembly 10.

Figure 9:
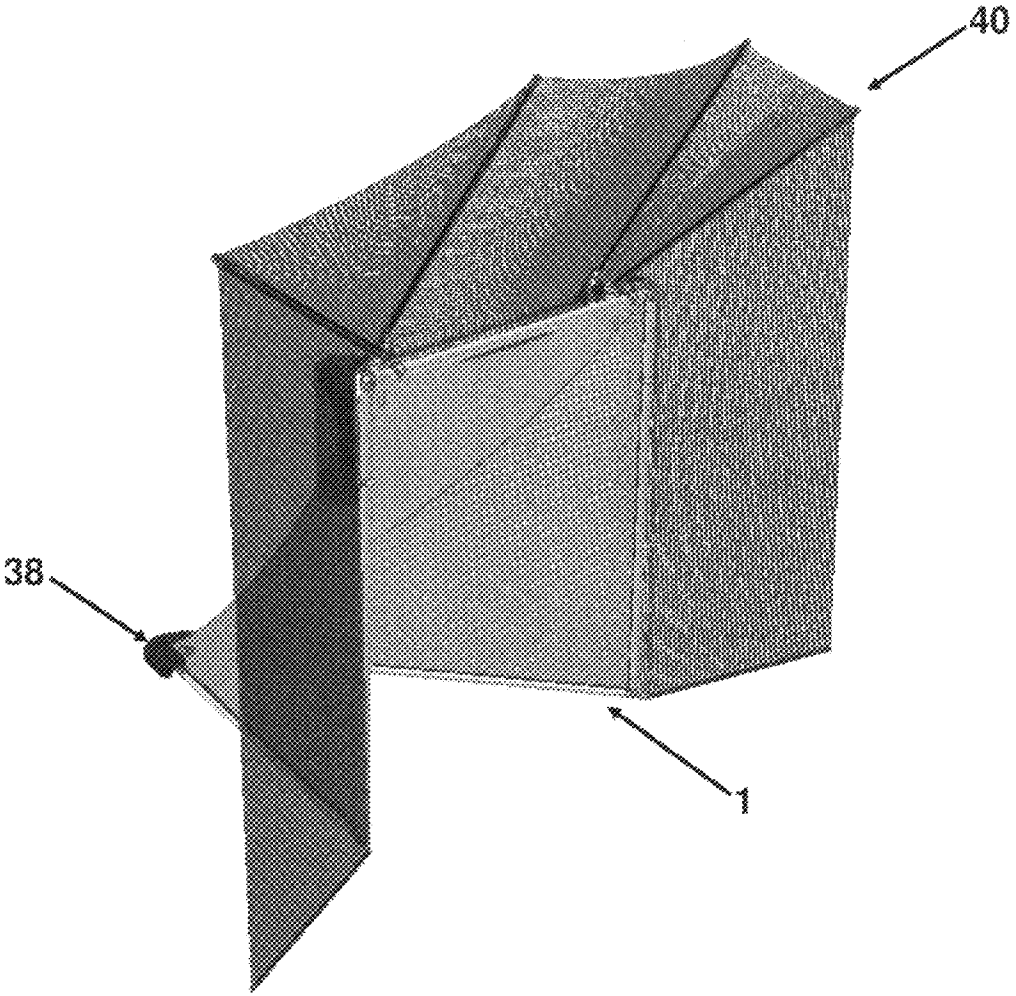
FIG. 9 illustrates an embodiment of the instant net frame assembly invention, wherein attached to said net frame assembly invention is a removably attached backstop assembly and a removably attached balancing system, including weight at the rear of said net frame.
Figure 10:
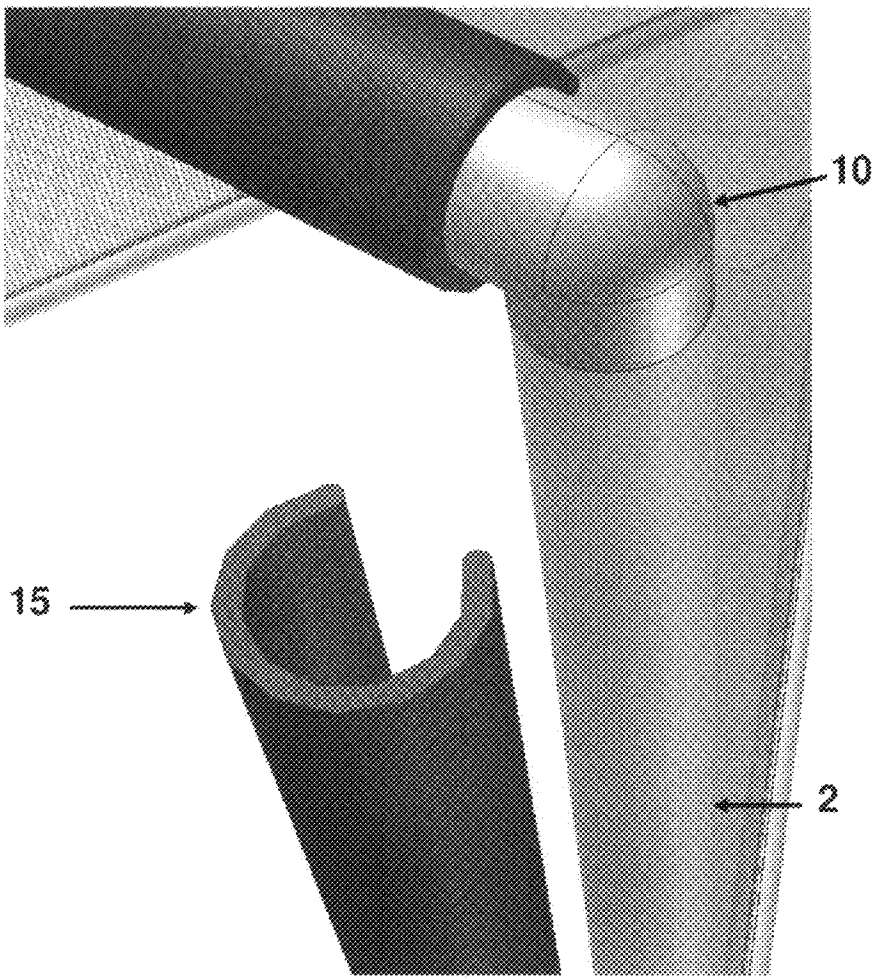
FIG. 10 illustrates an embodiment of the instant net frame assembly invention, wherein removable rebound members are attached or in position to be attached to the net frame assembly.
Figure 10A:
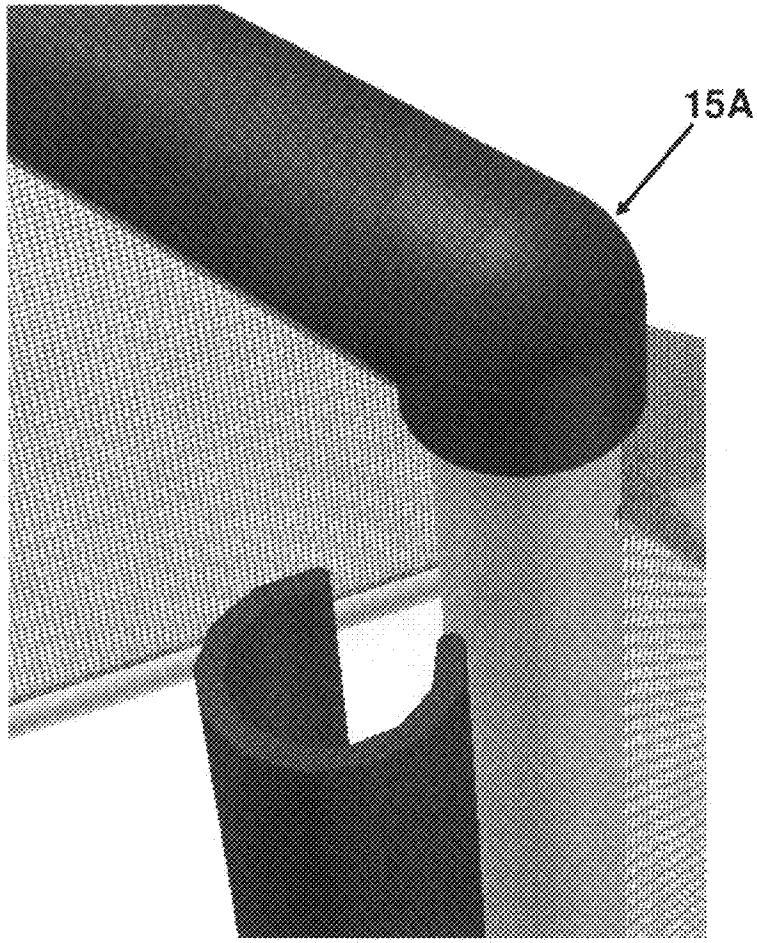
FIG. 10A illustrates an embodiment of the instant net frame assembly invention, wherein removable rebound members are attached or in position to be attached to the net frame assembly that comprises a preformed corner joint assembly.
Figure 11:
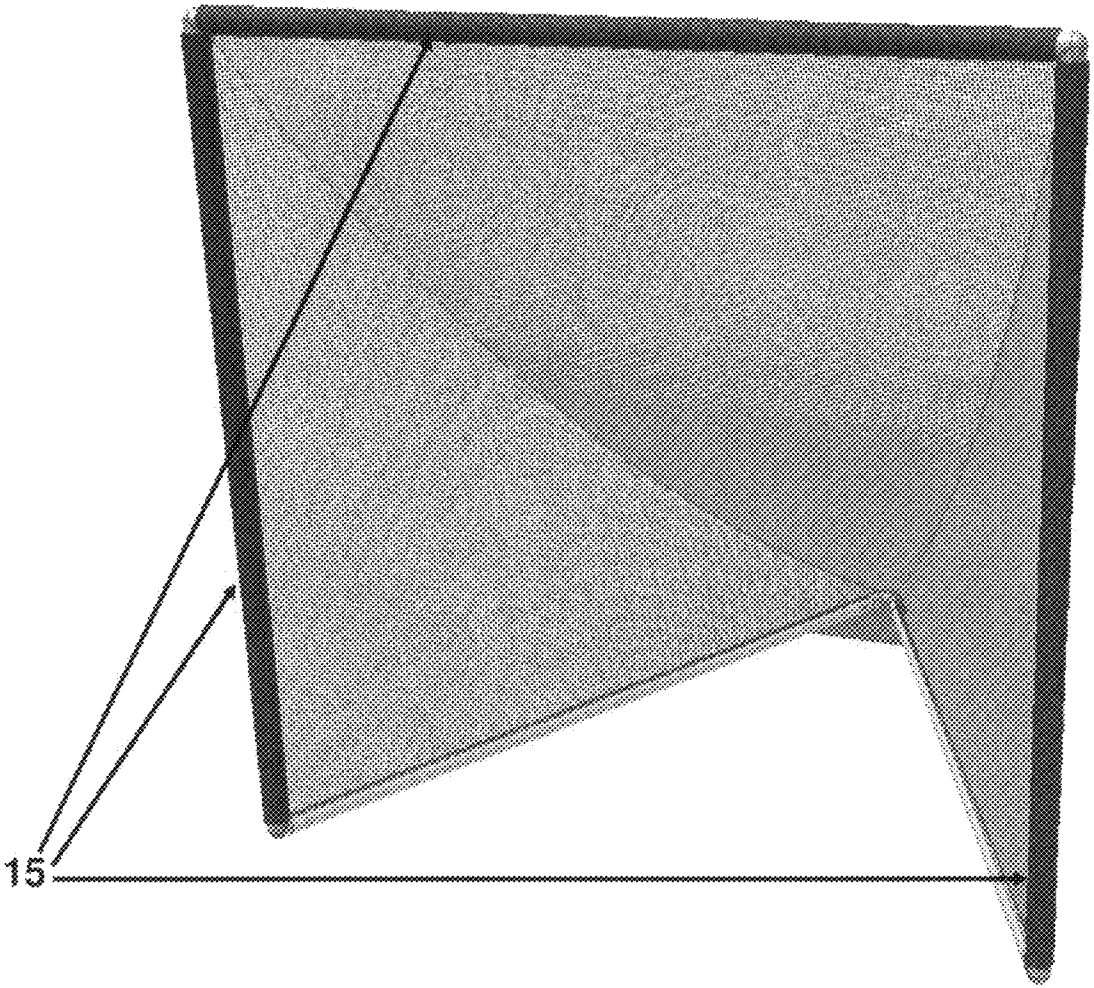
FIG. 11 illustrates a second angled frontal view of the net frame assembly, wherein said net frame assembly is fully assembled and a net is substantially installed to said net frame assembly.

FIG. 9 separately illustrates a removeably attached additional mass member 38 that removeably attaches about the rear of a fully assembled net frame assembly 1. This feature exists as a balancing mechanism and serves to add additional stability to the rear of the net frame. FIGS. 9, 10 and 11 illustrate the compatibility of the net frame assembly 1 with other functional components. FIG. 9 illustrates the net frame assembly 10 working in conjunction with an outer projectile receiving system 40 such as a goal frame backstop device as shown in FIG. 9. FIGS. 10 and 11 illustrate the assembly used in tandem with a frame impact protective system. The outer projectile receiving system 40 illustrated in FIG. 9 is installed about the net frame assembly 10.

FIG. 10 illustrates an exploded view of one impact protective member 15 before it is tensionally attached to a first frame member 2 and a second impact protective member after it has been tensionally attached to a second frame member 2. FIG. 11 illustrates a plurality of protective members 15 attached to all outer frame members 2 of the net frame assembly 1.

Figure 12:
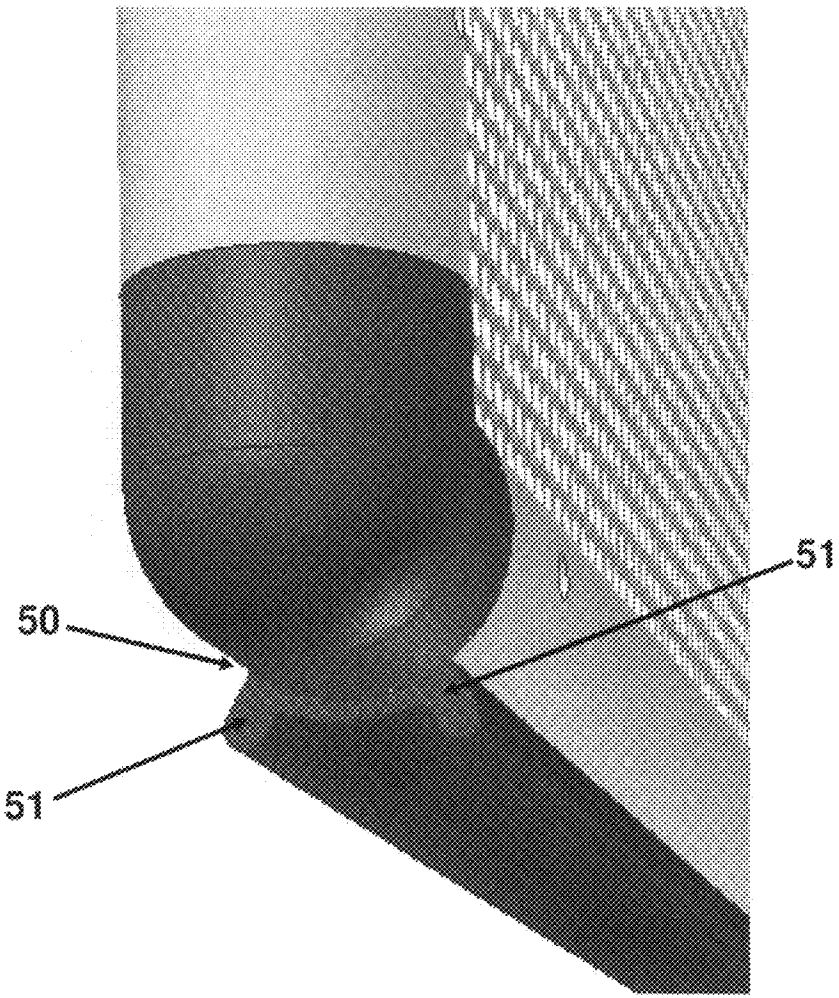
FIG. 12 illustrates a bottom isometric view of the net frame assembly, wherein said net frame assembly further comprises a substantially rubberized friction-increasing member.

FIG. 12 illustrates a bottom isometric view of a substantially rubberized surface gripping member 50, wherein said substantially rubberized surface gripping member 50 substantially increases the friction between the net frame assembly and the surface that it is in contact with (most commonly earth or a type of athletic flooring). To further increase the friction between the net frame assembly and the surface it is in contact with, said substantially rubberized surface gripping member 50 comprises at least two substantially angled rubberized protrusions 51 designed to directly make contact with the surface, ie ground, gymnasium floor, on which the net frame assembly is located.

Figure 13:
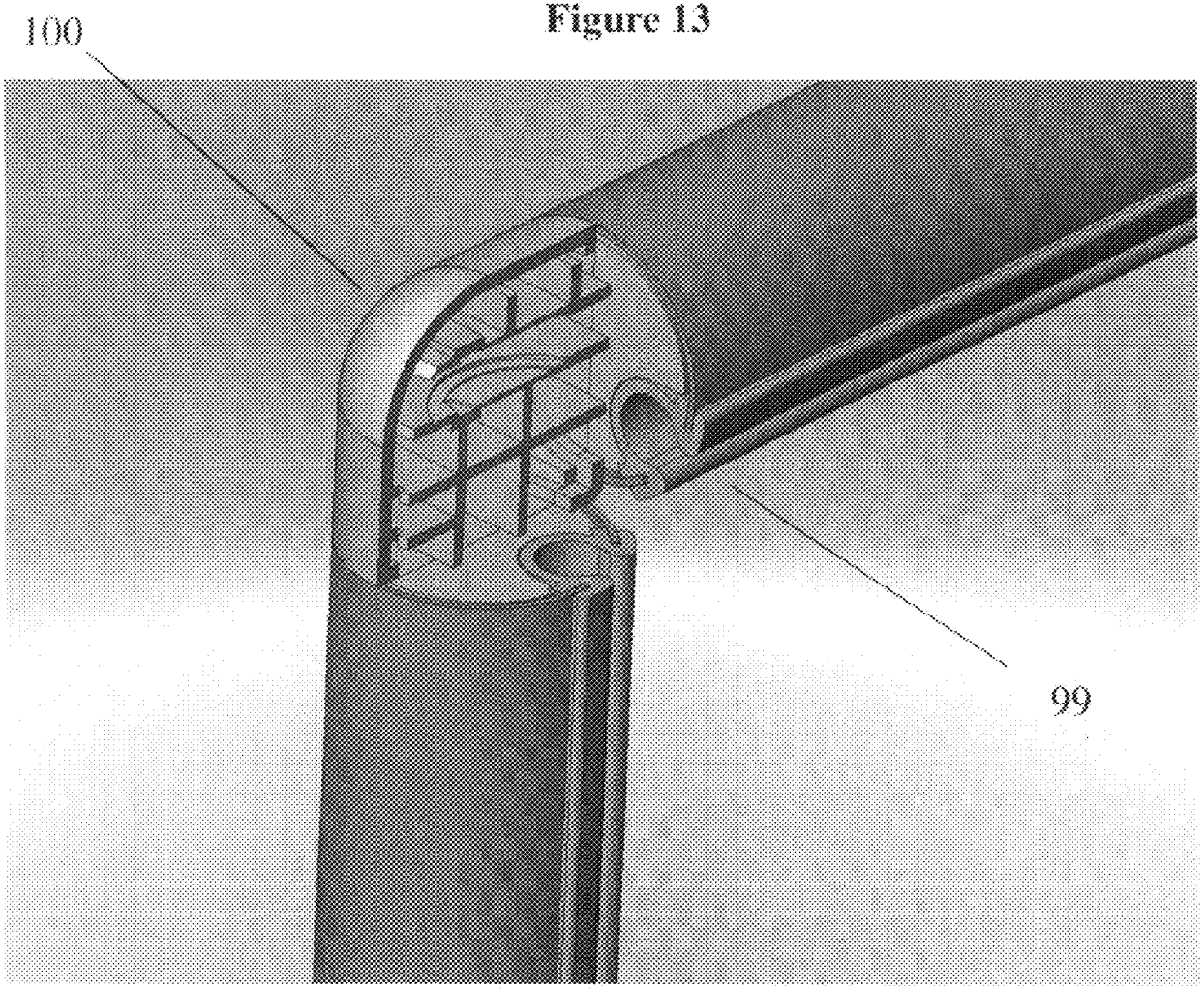
FIG. 13 illustrates an exploded view of an additional embodiment of the instant net frame assembly invention, wherein the top frame corner assembly is comprises the proprietary anti rotation key assembly feature to improve rigidity by minimizing excess motion/rotation of the goal frame. Also exemplified is the flexible extruded net cable, rod or retaining mechanism retainer channel, installed onto the frame pipe.
Figure 14:
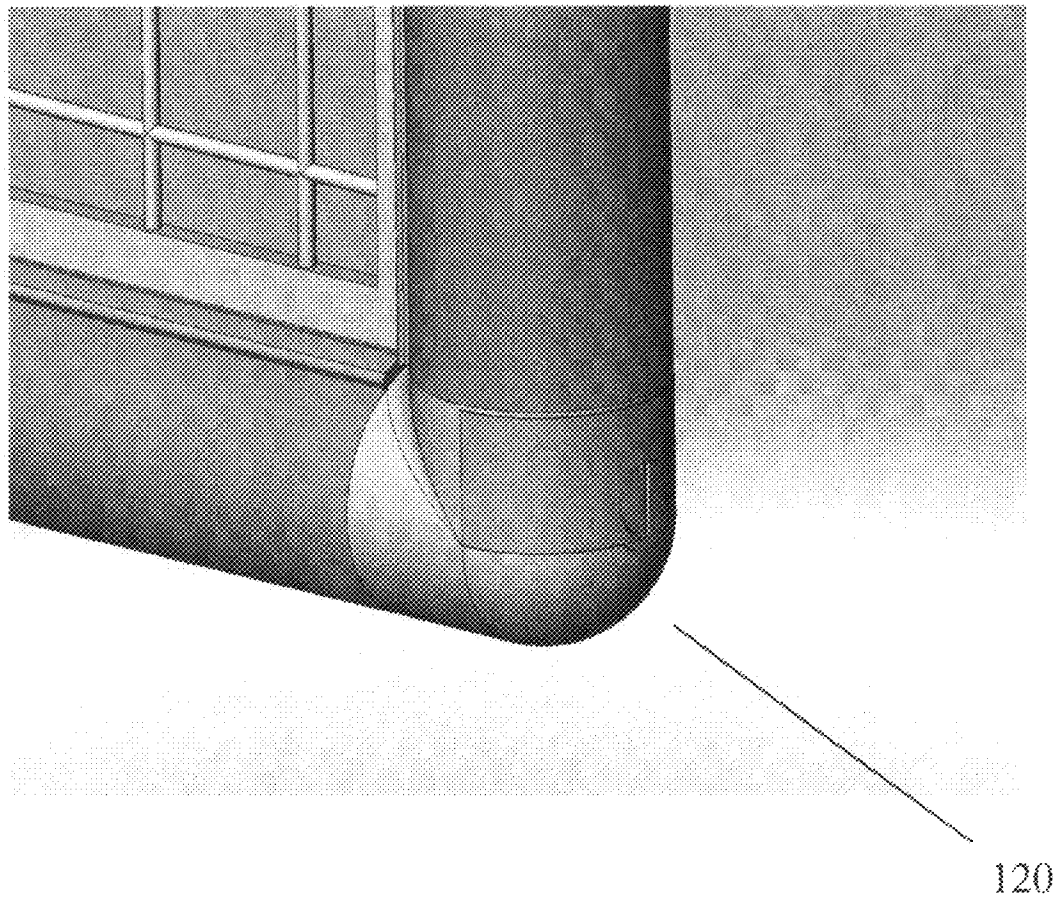
FIG. 14 illustrates an exploded view of the frame bottom corner assembly wherein the proprietary front loading net retaining system is shown partially installed.
Figure 15:
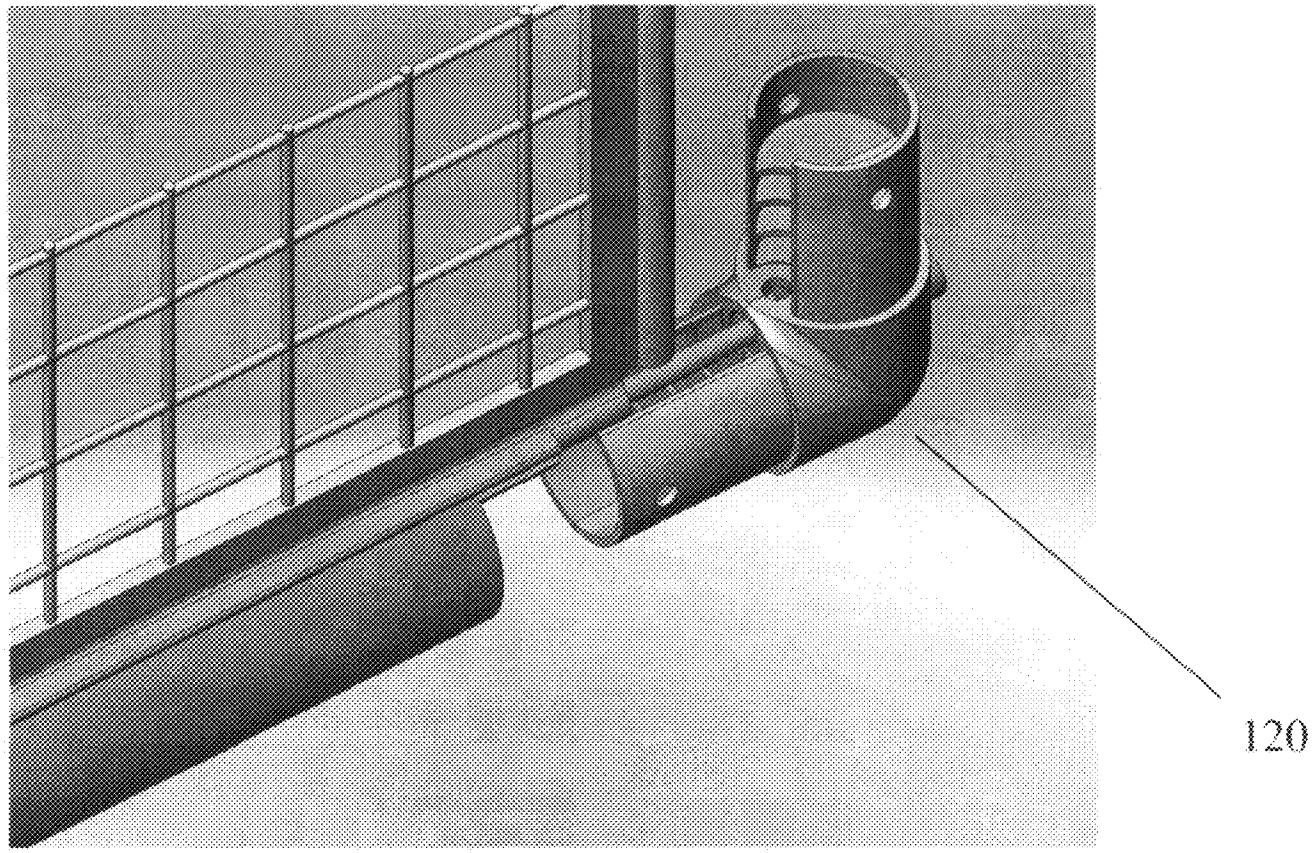
FIG. 15 illustrates an exploded view of the frame bottom corner assembly showing the proprietary front loading net retaining system is shown fully installed.
Figure 16:
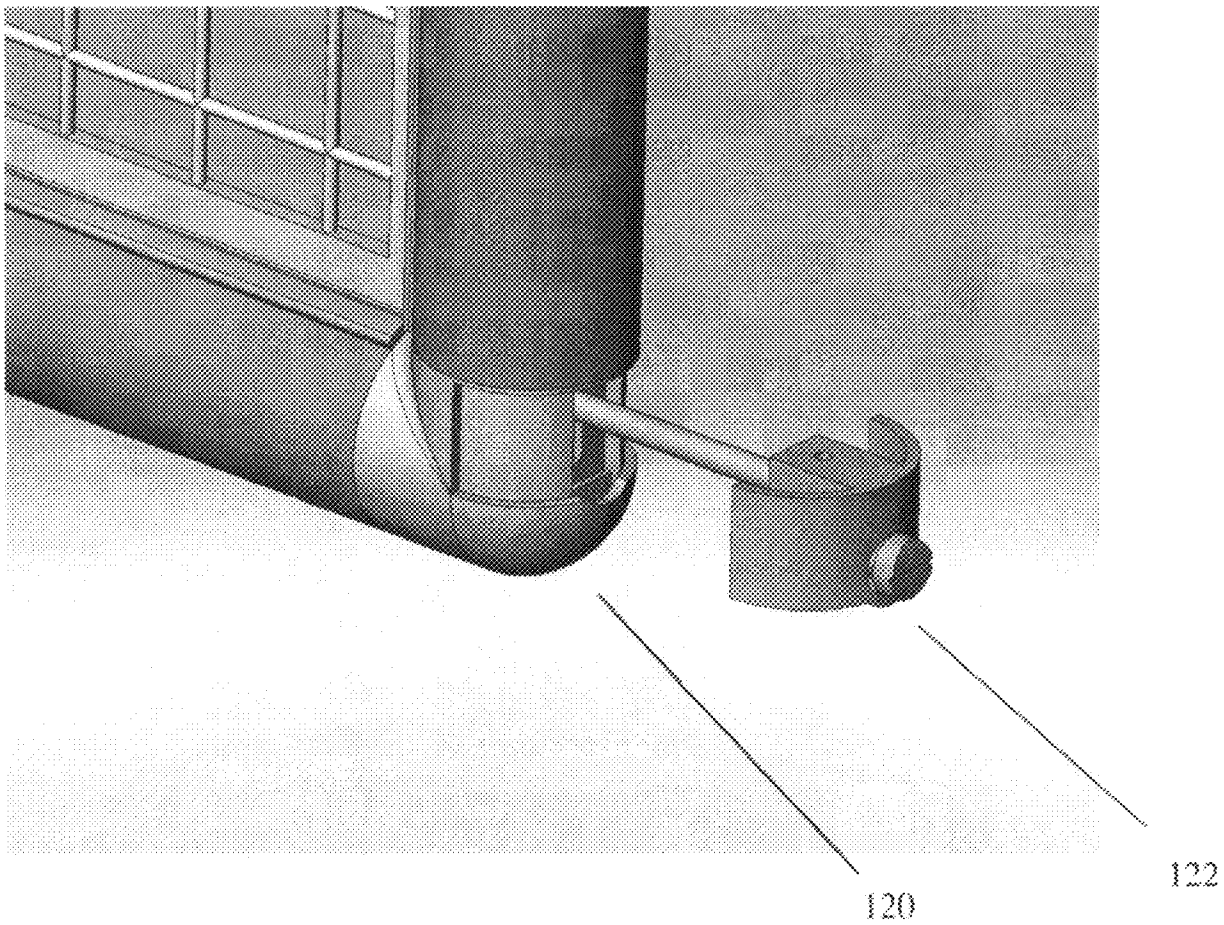
FIG. 16 illustrates an exploded left side rear view of the frame, net and net secure cable or rod system illustrating the net secure pockets inserted into the net secure frame slots.

In a further embodiment exemplifies an enhanced anti rotation structure. FIG. 13 illustrates an exploded view of an additional embodiment of the instant net frame assembly invention, wherein the top frame corner assembly is comprises the proprietary anti rotation key assembly 100 to improve rigidity by minimizing excess motion/rotation of the goal frame. Also exemplified is the flexible extruded net cable/rod retainer channel 99, installed onto the frame pipe. FIG. 14 illustrates an exploded view of the frame bottom corner assembly 120 wherein the front loading net cable/rod secure system is shown fully installed. FIG. 15 illustrates an exploded view of the frame bottom corner assembly showing 120 the front loading net cable/rod secure system is shown partially installed. FIG. 16 illustrates an exploded left side rear view of the frame net and net secure cable/rod system 120 showing the net secure pockets 122 inserted into the net secure frame slots.

Figure 17:
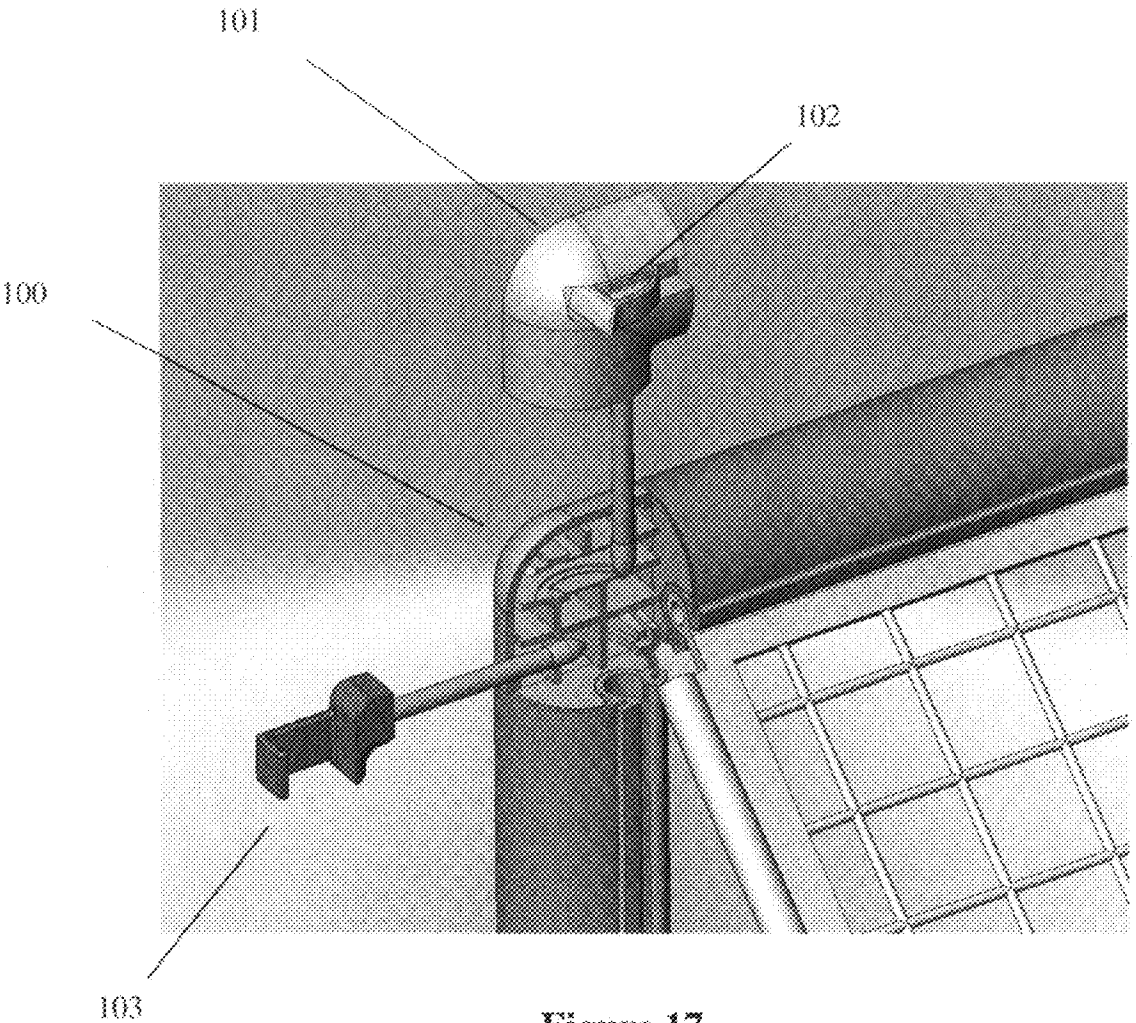
FIG. 17 illustrates an exploded left side rear view of the proprietary goal frame and net retaining system.
Figure 18:
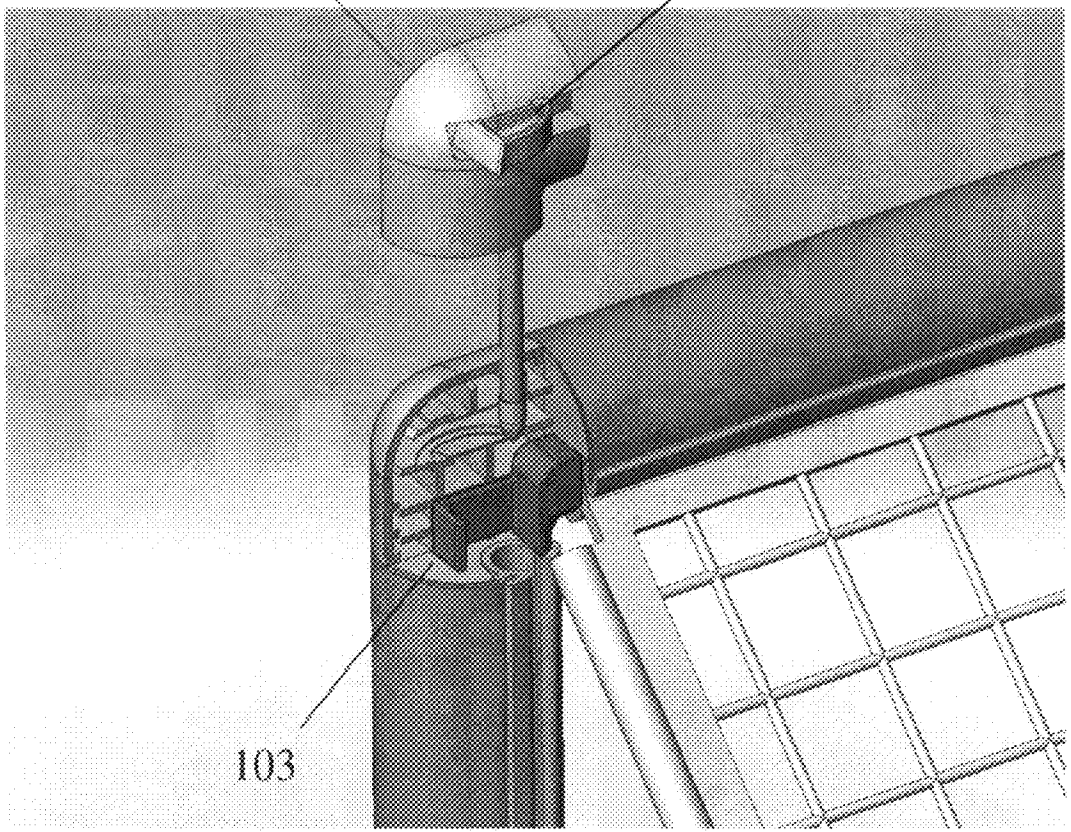
FIG. 18 illustrates an exploded left side rear view of the frame and net secure cable/rod system. The horizontal and vertical cables net secure cables are shown completely installed and locked in place.
Figure 19:
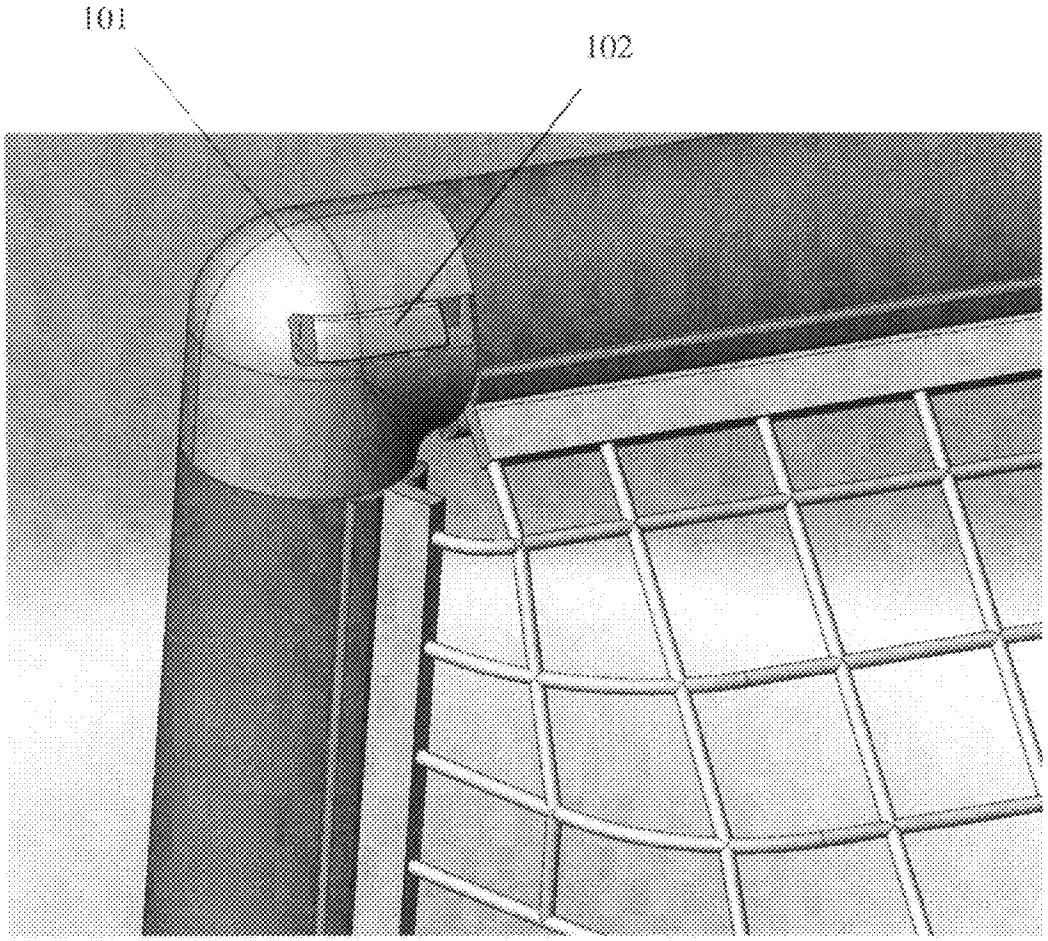
FIG. 19 illustrates a left side rear view of the frame and net secure cable/rod system. The horizontal and vertical cables net retaining cables are shown completely installed and locked in place; and, FIG. 20 illustrates a left side rear exploded view of all components of the frame and net secure cable/rod system.
Figure 20:
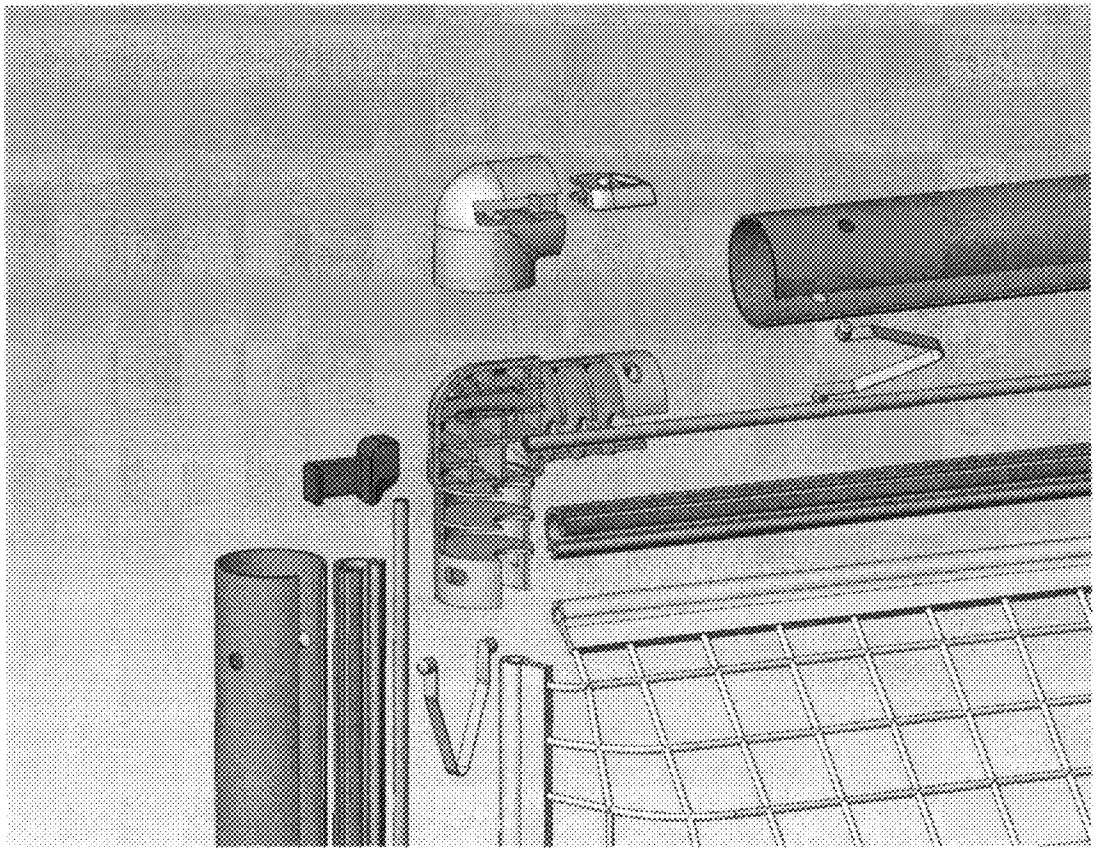

FIG. 17 illustrates an exploded left side rear view of the frame and net secure cable/rod system 100, further exemplifying the vertical net secure cable/rod 101, the vertical net secure cable/rod locking mechanism 102 and horizontal net secure cable/rod 103 are shown prior to installation. FIG. 18 illustrates an exploded left side rear view of the frame and net secure cable/rod system 100, further exemplifying the vertical net secure cable/rod 101, the vertical net secure cable/rod locking mechanism 102 and horizontal net secure cable/rod 103, with the horizontal net secure cable/rod locked into place. FIG. 19 illustrates a left side rear view of the frame and net secure cable/rod system with the vertical net secure cable/rod 101, the vertical net secure cable/rod locking mechanism 102 and horizontal net secure cable/rod 103 completely installed and locked in place. FIG. 20 illustrates a left side rear exploded view of all components of the frame and net secure cable/rod system, disassembled.

What is claimed is:

1. A net frame assembly comprising:

at least one elbow joint assembly;

at least one outer frame member, wherein said at least one outer frame member comprises at least one tether member passage groove;

at least one substantially rubberized surface gripping member;

at least one removably attached balancing mechanism; and at least one projectile motion absorbing member having an inner face and an outer face, wherein said at least one projectile motion absorbing member substantially prevents solid matter projectiles from passing through said at least one projectile motion absorbing member and wherein the at least one elbow joint assembly further comprises: a preformed elbow joint member; a plurality of cable securing member cavities; a tethering member; a tether securing member; a joint lock member; wherein the tethering member and the tether securing member pass through a plurality of elbow joint tethering member passage grooves within the frame and wherein the joint lock member secures the elbow in place.

2. The net frame assembly of claim 1, wherein said inner face of said at least one projectile motion absorbing member further comprises at least one projectile motion absorbing member tethering member channel member.

3. The net frame assembly of claim 2, wherein said at least one elbow joint assembly comprises:

at least one elbow joint;

at least one interlocking joint member; and at least one foundation elbow, wherein said at least one foundation elbow adjacently interlocks to said at least one interlocking joint member.

4. The net frame assembly of claim 3, wherein said at least one projectile motion absorbing member further comprises at least one tether member channel member.

5. The net frame assembly of claim 4, wherein said net frame assembly further comprises at least one impact protective channel.

6. The net frame assembly of claim 5, wherein said net frame assembly comprises at least one vertically positioned outer frame member.

7. The net frame assembly of claim 6, wherein said at least one elbow joint assembly further comprises at least one securing member cavity disposed to receive a securing member within said at least one securing member cavity.

8. The net frame assembly of claim 7, wherein said net frame assembly further comprises at least one tethering member.

9. A non-depression component snap together net frame assembly comprising:

at least one elbow joint assembly, wherein said frame joint assembly attaches to at least one tethering member;

at least one V-angled joint assembly;

at least one substantially rubberized surface gripping member;

at least one removably attached additional balancing mechanism;

at least one outer frame member comprising at least one tether member passage groove, wherein said at least one tether member passage groove allows for at least one tethering member resting within at least one tether member passage to securely rest within said at least one tether member passage groove; and at least one projectile motion absorbing member having an inner face and an outer face, wherein said at least one projectile motion absorbing member substantially prevents solid matter projectiles from passing through said at least one projectile motion absorbing member and wherein the at least one elbow joint assembly further comprises: a preformed elbow joint member; a plurality of cable securing member cavities; a tethering member; a tether securing member; a joint lock member; wherein the tethering member and the tether securing member pass through a plurality of elbow joint tethering member passage grooves within the frame and wherein the joint lock member secures the elbow in place.

10. The non-depression component snap together net frame assembly of claim 9, wherein said inner face of said at least one projectile motion absorbing member further comprises at least one projectile motion absorbing member tethering member channel member, wherein said tethering member passage allows for a tethering member to rest within said tethering member passage and, wherein said tethering member further comprises at least one cable stopper member.

11. The non-depression component snap together net frame assembly of claim 10, wherein said at least one elbow joint assembly comprises:

at least one preformed elbow joint;

at least one interlocking joint member;

at least one lock joint cavity;

at least one foundation elbow adjacently interlocking to said at least one interlocking joint member; and, wherein said at least one V-angled joint assembly comprises at least one cable stopper cavity member.

12. The non-depression component snap together net frame assembly of claim 11, wherein said at least one projectile motion absorbing member further comprises at least one tether member channel member, wherein said tether member passage substantially allows for at least one tethering member to rest within said tether member channel member.

13. The non-depression component snap together net frame assembly of claim 12, wherein said net frame assembly further comprises at least one impact protective tube.

14. The non-depression component snap together net frame assembly of claim 13, wherein said net frame assembly further comprises at least one vertically positioned outer frame member and at least one horizontally positioned outer frame member, wherein at least one member of said at least one vertically positioned outer frame member and at least one member of said at least one horizontally positioned outer frame are substantially perpendicular to each other.

15. The non-depression component snap together net frame assembly of claim 14, wherein said at least one elbow joint member further comprises at least one securing member cavity disposed to receive a securing member within said securing member cavity.

16. The non-depression component snap together net frame assembly of claim 15, wherein said net frame assembly further comprises at least one tethering member comprising at least one tether securing member, wherein said tether securing member is attached to said tethering member and said tether securing member secures said tether member to a second net frame assembly.

17. The non-depression component snap together net frame assembly of claim 16, wherein said net frame assembly further comprises a net comprising a pocket for collecting objects in a rearward portion of said net frame assembly and a retrieval opening for removal of objects from a rearward portion of said net frame assembly.

18. The net frame assembly of claim 1 wherein the at least one elbow joint assembly further comprises:

a latch assembly;

a second elbow joint member;

a latch assembly cavity member;

a cable member;

a cavity member comprising an entrance; and, a cable stopping member, wherein the latch assembly is removably attached to the second elbow joint member and the latch assembly locks into the second elbow joint member by a latch assembly cavity member; and wherein the cable member is placed through the cavity member and the cable stopping member lis flush against the entrance to the cavity member.

19. A net frame assembly comprising an enhanced anti-rotation structure comprising:

a series of frame pipes;

a series of frame corner assemblies comprising at least two top frame corner assemblies and at least three bottom frame corner assemblies and wherein the at least two top frame corner assemblies comprise:

an anti-rotation key assembly;

a flexible extruded net cable/rod retainer channel installed onto the series of frame pipes;

a vertical net secure cable/rod;

a vertical net secure cable/rod locking mechanism; and, a horizontal net secure cable/rod and having at least one elbow joint assembly further comprising: a preformed elbow joint member; a plurality of cable securing member cavities; a tethering member; a tether securing member; a joint lock member; wherein the tethering member and the tether securing member pass through a plurality of elbow joint tethering member passage grooves within the frame and wherein the joint lock member secures the elbow in place.

20. The net frame assembly comprising an enhanced anti-rotation structure of claim 19 wherein the at least three bottom frame corner assemblies further comprise:

at least three front loading net cable/rod secure system comprising net secure frame slots; and, at least three net secure pockets.

21. A method of projectile motion absorption utilizing the device of claim 1 or 9 in an athletic setting comprising the steps of:

assembling a net frame assembly comprising:

at least one elbow joint assembly;

at least one outer frame member, wherein said at least one outer frame member comprises at least one tether member passage groove; and at least one projectile motion absorbing member having an inner face and an outer face, wherein said at least one projectile motion absorbing member substantially prevents solid matter projectiles from passing through said at least one projectile motion absorbing member;

placing at least one protective member on said at least one outer frame member and placing said outer face of said at least one projectile motion absorbing member onto said at least one outer frame member.

* * * * *